US005448940A

United States Patent [19]

Schuetz et al.

[11] Patent Number: 5,448,940

[45] Date of Patent: Sep. 12, 1995

[54] GAS-OPERATED M16 PISTOL

[75] Inventors: Robert C. E. Schuetz; Brian D. Schuetz, both of Olympia, Wash.

[73] Assignee: Olympic Arms, Inc., Olympia, Wash.

[21] Appl. No.: 154,976

[22] Filed: Nov. 19, 1993

[51] Int. Cl.[6] ..... F41A 5/24

[52] U.S. Cl. ..... 89/185; 89/128

[58] Field of Search ..... 89/128, 185, 191.01

[56] References Cited

U.S. PATENT DOCUMENTS

| | | | |
|---|---|---|---|
| 2,951,424 | 9/1960 | Stoner | 89/191.01 |
| 3,045,555 | 7/1962 | Stoner | 89/142 |
| 3,236,155 | 2/1966 | Sturtevant | 89/199 |
| 3,301,133 | 1/1967 | Sturtevant | 89/131 |
| 3,318,192 | 5/1967 | Miller et al. | 89/142 |
| 3,618,457 | 11/1971 | Miller | 89/185 |
| 3,675,534 | 7/1972 | Beretta | 89/185 |
| 3,724,325 | 4/1973 | Silsby | 89/185 |
| 3,742,636 | 7/1973 | Dealy et al. | 89/199 |
| 4,358,986 | 11/1982 | Giorgio | 89/142 |
| 5,272,956 | 12/1993 | Hudson | 89/128 |

FOREIGN PATENT DOCUMENTS

| | | | |
|---|---|---|---|
| 613942 | 12/1948 | United Kingdom | 89/191.01 |

*Primary Examiner*—Stephen C. Bentley

*Attorney, Agent, or Firm*—Michael J. Caddell

[57] ABSTRACT

A modified M16 pistol capable of firing rifle cartridges therein in automatic or semi-automatic mode, which pistol is based upon modified M16 upper and lower assemblies, with a pistol barrel, an M16 gas actuation system, and a spring-biased buffer system mounted on top of the M16 upper receiver assembly.

9 Claims, 3 Drawing Sheets

GAS-OPERATED M16 PISTOL

BACKGROUND OF THE INVENTION

The present invention is directed to the field of firearms and more particularly involves an automatic/semi-automatic hand-held pistol based on the design of the military M16 rifle.

The M16 automatic rifle and the AR15 semi-automatic rifle have been the standard issue weapons of the U.S. military and civilian police departments for decades. The rifle design was originated by E. M. Stoner and developed by Fairchild Engine and Airplane Company in the 1950's. Modified versions of the M16 designated as the M16A1 and M16A2 are currently in use by armed forces in the U.S. and throughout the world. A civilian semi-automatic version of the M16 designated as the AR15 is sold to civilians by Olympic Arms of Olympia, Wash. When used herein, the phrase "M16" is intended to include all versions of the M16 and AR15 previously and currently being produced.

One of the basic patents on gas-operated firearms was U.S. Pat. No. 2,951,424 issued to E. S. Stoner on Sep. 6, 1960, disclosing the M16 bolt and bolt carrier system and the gas operation thereof. This patent discloses a rifle utilizing a gas tube that extends from gas ports in the barrel, back into the receiver of the rifle and into a gas tube pocket or "key" attached to the bolt carrier.

Other patents which disclose conventional AR15 and M16 designs include U.S. Pat. No. 3,236,155 to Sturtevant issued Feb. 22, 1966, and U.S. Pat. No. 3,742,636 to Dealy et al. issued Jul. 3, 1973.

U.S. Pat. No. 3,675,534, issued to P. C. Beretta on Jul. 11, 1972, discloses a gas-operated automatic rifle having a piston and stem inside a gas tube with the stem fixedly attached to the bolt carrier.

U.S. Pat. No. 4,358,986, issued to C. Giorgio on Nov. 16, 1982, discloses a gas-operated automatic rifle having a stationary piston and a segmented movable gas cylinder/operating rod assembly including a biasing spring.

U.S. Pat. No. 3,618,457, issued to A. Miller on Nov. 9, 1971, and U.S. Pat. No. 3,318,912, issued to Miller on May 9, 1967, both disclose a gas-operated rifle utilizing a gas-operated piston and rod assembly with the piston rod telescopically mounted over a stationary guide rod and being spring-biased.

While the aforementioned patents all disclose various constructions for M16 rifles having gas-operated bolt assemblies, none discloses structure for utilization as a pistol having the M16 type of upper and lower receivers, sliding and rotating bolt assembly, and gas operation.

Also, whereas numerous automatic and semi-automatic pistol designs are known in the art, they utilize a "blowback" design wherein the bolt is not locked up in the chamber when the cartridge is fired. Furthermore, the automatic and semi-automatic pistol designs that are utilized are designed for the relatively mild, low pressure cartridges generally associated with pistols and revolvers, such as the 45 ACP, 9 mm, 38 special, and 357 and 44 magnum calibers. To the best of this inventor's knowledge, no automatic or semi-automatic pistol design has ever been commercialized that is capable of handling the long "bottle-necked" rifle cartridges or of handling the high pressures generated in such rifle cartridges. The pressures normally associated with conventional pistol cartridges generally range from around 30,000 up to about 40,000 CUP (copper units of pressure). This allows for the use of the limited "blow-back" bolt design.

Rifle cartridges, on the other hand, are generally much larger in powder capacity and generate internal pressures in the range of about 50,000 to 60,000 CUP, requiring a locking bolt design. Semi-automatic and automatic pistol designs are incapable of handling rifle cartridges.

In addition, the conventional M16 rifle design does not lend itself to a pistol design for several reasons. One reason is the length of the M16 bolt assembly (bolt and bolt carrier) which requires a long chamber area to the rear of the upper receiver to allow cycling of the bolt assembly backward during the firing cycle. Another reason is the requirement for a buffer tube extending from the rear of the receiver area for containing a buffer and buffer spring which are necessary in the M16 for absorbing the recoil of the bolt and then cycling the bolt forward after a cartridge has been fired.

SUMMARY OF THE INVENTION

The present invention overcomes the disadvantages of the above-described firearms by providing a modified M16 pistol design that utilizes standard rifle cartridges such as the 5.56 mm NATO (.223 Rem.) caliber without need for an extended buffer chamber at the rear of the pistol. The present invention achieves its advantages by providing a modified M16 pistol which utilizes a shortened M16 bolt assembly and a spring-biased buffer system mounted in the upper portion of the receiver, above the bolt assembly.

DESCRIPTION OF THE PREFERRED EMBODIMENT

Figure 1:
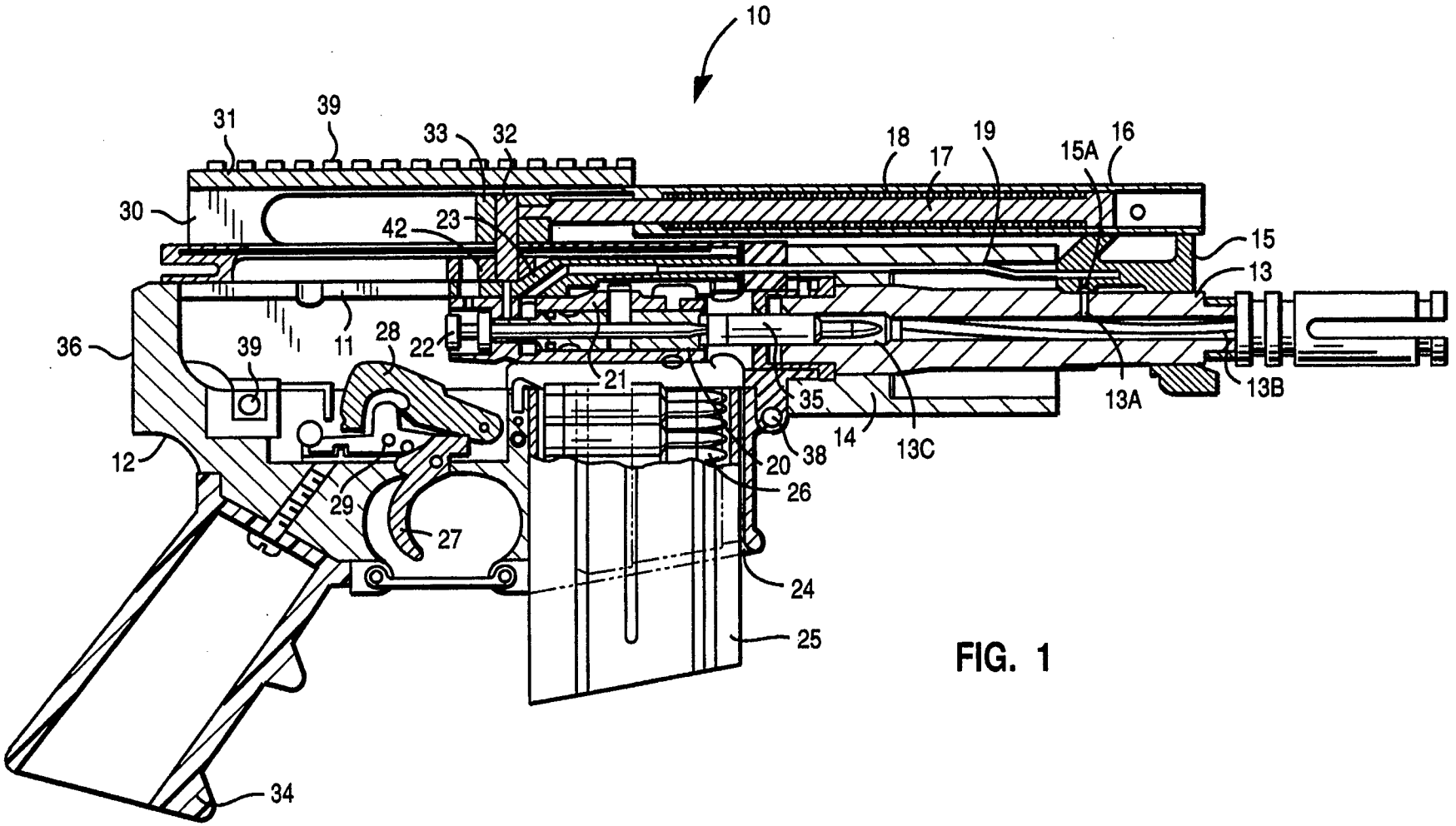
FIG. 1 is a cross-sectional side view of the pistol of the present invention seen from the right hand side.

Referring now to FIG. 1, which is a cross-sectional side view of the M16 pistol of the present invention, the pistol 10 consists of an upper receiver 11 pivotally attached to a lower receiver 12 and having a barrel 13 threadedly engaged in the upper receiver 11. A cylindrical handguard 14 threadedly engages the forward end of the upper receiver 11 and secures barrel 13 to the upper receiver by engaging an external shoulder formed on barrel 13. A gas manifold block 15 encircles barrel 13 and has attached to the top thereof a cylindrical buffer housing 16. A snug-fitting slidable buffer rod 17 is located in buffer housing 16 and has located thereon, in annular relationship with housing 16, a helical coiled buffer spring 18 arranged to be engaged by the right hand end of the buffer rod 17 and the left end of buffer housing 16 such that movement of the buffer rod out of the housing to the left serves to compress buffer spring 18. Buffer spring 18 thereby resiliently biases buffer rod 17 to the right inside housing 16 and maintains it in a retracted telescopic position therein.

A gas tube 19 snugly engaged in gas manifold 15 communicates with a bore passage 15A passing through the lower portion of manifold 15 and communicating with gas port 13A formed in barrel 13. Barrel 13 has a central rifled bore portion 13B passing from a cartridge chamber area 13C to the muzzle end of barrel 13. Gas passage 13A communicates with rifled bore 13B.

At the left-most end of gas tube 19 is a gas key 23 slidably engaged over the end of gas tube 19 and fixedly attached to the top of a modified M16 bolt carrier 21. Bolt carrier 21 has located therein, in a partially rotatable and slidable relationship, a conventional M16 bolt 20 having a conventional M16 firing pin 22 slidably located therein.

Lower receiver 12 and all of the components located therein including magazine 25, cartridges 26, trigger 27, hammer 28, disconnector 29, and pistol grip 34 are of a conventional M16 design except for one modification. That modification consists of the rearward or left-most end 36 of lower receiver 12 which is a solid bulkhead or plate as opposed to the open bore threaded end of a conventional M16 lower receiver. The solid end face 36 of lower receiver 12 can be more clearly seen in FIG. 2. Otherwise, all the remaining components located in the lower receiver 12, commonly referred to as the lower receiver assembly, are of the conventional M16 construction. Likewise, the bolt 20 and firing pin 22 comprise a conventional bolt assembly of an M16 rifle. The bolt carrier 21 of the present invention is modified significantly from that of the conventional M16 as can be more clearly seen in FIGS. 1 and 4.

Figure 2:
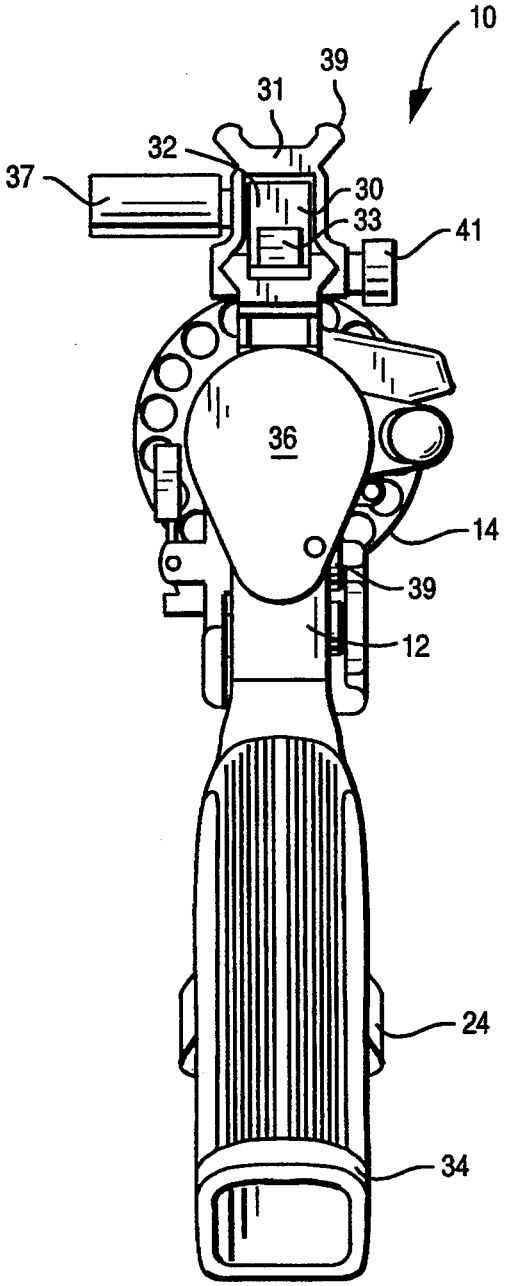
FIG. 2 is a rear view of the pistol of FIG. 1.
Figure 3:
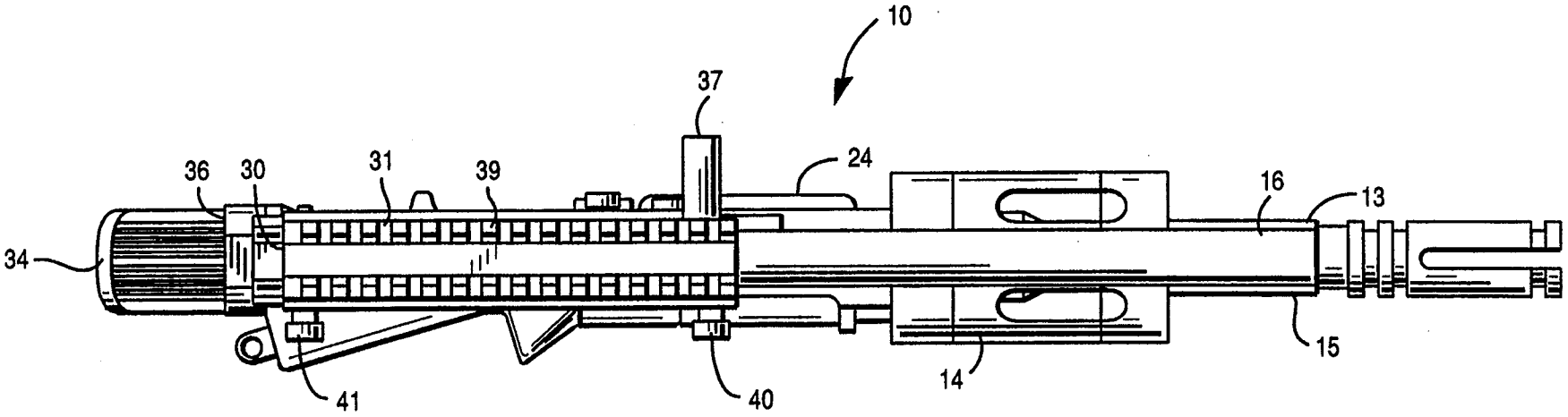
FIG. 3 is a top view of the pistol of FIG. 1.

Upper receiver 11 is also modified considerably from the conventional M16 structure. The upper receiver 11 differs from an M16 upper receiver in the construction of an upper spring buffer assembly comprising the buffer housing 16, buffer rod 17, buffer spring 18, buffer connector 32 and buffer connector sleeve 33. Also, not shown in FIG. 1, but illustrated clearly in FIGS. 2 and 3 is a charging handle 37 threadedly engaged in the left hand side of connector sleeve 33 and projecting outward through a slot formed in slide housing 30. Slide housing 30 comprises a relatively rectangular shaped box portion attached permanently to the top of the upper receiver 11, fixedly connected to the left end of housing 16, and containing therein a slide area for connector sleeve 33. Connector sleeve 33 is threadably attached at the rearward end of buffer rod 17 and is also connected to bolt carrier 21 by means of buffer connector 32 which comprises a cylindrical metal pin extending downward and having a threaded end portion at the bottom thereof to threadably engage in the conventional gas key bolt hole formed in the bolt carrier 21. In this embodiment, buffer connector pin 32 threadably engages in the front gas key bolt hole in bolt carrier 21 and a conventional gas key screw is located in the rear gas key screw hole providing additional attachment means for connecting gas key 23 to bolt carrier 21 as is known in the conventional M16 design.

FIG. 2 represents the rear view of the M16 pistol of the present invention. In FIG. 2 can be clearly seen the charging handle 37 extending leftward out of the slot formed in slide housing 30 and also being threadedly engaged at the innermost end in connector sleeve 33. Also obvious in FIG. 2 is the blanked off rearmost end 36 of the lower receiver. As in conventional M16 construction, the upper receiver 11 is pivotally connected to the lower receiver 12 by front pivot pin 38 and rear pivot pin 39 visible in FIG. 1.

Referring now to FIG. 3, which is a top view of the invention, the top rear sight base 31 can be seen comprising a series of ridges and grooves adapted to receive conventional "Weaver" type scope mount rings available commercially from the Weaver Scope Company, El Paso, Tex. Also visible in top view 3 is the charging handle 37 extending leftwardly from the slide housing 30 and the front and rear thumb screws 40 and 41 which serve to attach the slide housing 30 to upper receiver 11.

Figure 4:
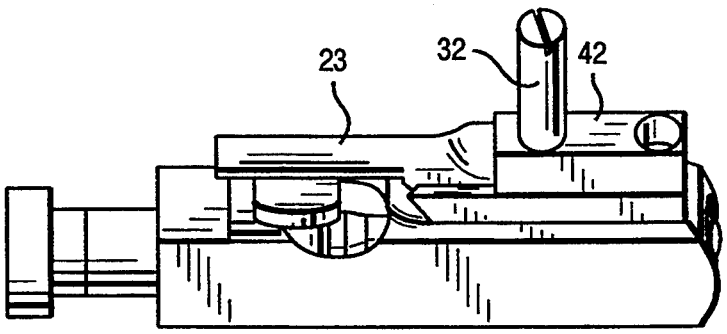
FIG. 4 is a view of the bolt assembly used in the pistol.

FIG. 4 is a side view of the modified bolt carrier/bolt assembly 20, 21 of the M16 pistol. As previously mentioned, bolt 20 is a conventional M16 type bolt having a side-mounted extractor and a face-mounted ejector pin. Also, firing pin 22 passing through the center of bolt 20 is of a conventional M16 design. The bolt carrier 21 is of a modified M16 design having a conventional front portion but the rear portion which extends from the end of the firing pin backward has been removed. Sitting atop bolt carrier 21 and threadedly attached thereto by a conventional gas key screw as well as buffer pin 32, is gas key 23 which is modified from a conventional M16 gas key. The major modification thereof is the provision of a buffer engagement block 42 which is permanently attached to the gas key by means such as welding. Block 42 is a rectangular-shaped block having a pair of cylindrical openings bored therethrough to allow threading of the rearward gas key retention screw and threading of the buffer connector pin 32 into the normal gas key attachment threads in the bolt carrier. Block 42 provides lateral support for the engagement of buffer connector pin 32 with the entire bolt/bolt carrier assembly. This provides a spreading of the lateral forces from charging handle 37 into the bolt carrier 21 while the operator of the firearm is pulling the bolt carrier assembly rearwardly to load a live round of ammunition into the chamber and also during cycling of the bolt assembly during the firing cycle.

In typical operation, the M16 pistol 10 will have the bolt/bolt carrier assembly 20, 21 resting in the forward position. A loaded magazine 25 containing live rounds of ammunition 26 is loaded upward into magazine housing 24 until the magazine engages a magazine catch as usual in a conventional M16 rifle. The charging handle 37 is then pulled rearwardly to its rearmost travel point near the end of slide housing 30 which pulls with it the bolt/bolt carrier assembly 20, 21 to its rearmost position while simultaneously pulling buffer rod 17 rearwardly and compressing coil spring 18 between the forward end of rod 17 and the rearward end of buffer housing 16. When the bolt/bolt carrier assembly has reached its rearmost position and the connector sleeve engages the rearward end of slide housing 30, the operator of the weapon then releases the charging handle and the force of compressed spring 18 slides the buffer rod 17 and the connector pin 32 forward which simultaneously pulls bolt/bolt carrier assembly 20, 21 forward. As the bolt/bolt carrier assembly moves forward, it strips a live round from magazine 25 and moves it into the chamber of barrel 13.

Utilizing conventional M16 camming procedures, bolt 20 moves into locking engagement in the chamber by passing through the chamber locking lugs and then rotating behind, thereby providing full lock-up of the bolt in the chamber prior to firing of the cartridge. When the trigger 27 is pulled, hammer 28 is released and strikes firing pin 22 driving it into the primer of the cartridge 35 thereby firing the cartridge. The bullet from the cartridge passes down the rifle bore 13B and exits the muzzle end of barrel 13. After the bullet passes by gas port 13A, heated gases from firing of the cartridge pass up through gas port 13A into gas passage 15A formed in manifold 15. The gas then passes down gas tube 19 and impacts gas key 23 camming the bolt out of engagement with the locking lugs and driving bolt-/bolt carrier assembly 20, 21 rearward in the housing until the compression of spring 18 slows and then stops rearward movement of the bolt/bolt carrier assembly. The compressive force stored in spring 18 then drives the buffer rod 17 and the bolt/bolt carrier assembly forward again, stripping another live round from the magazine and reloading the gun for firing. Just as in a conventional M16, the movement of bolt/bolt carrier 20, 21 rearward also serves to recock hammer 28 and trigger 27 by conventional means utilized in M16 rifles. This is accomplished by rearward movement of the bolt carrier against the hammer which pushes the hammer back into a cocked position as the bolt carrier slides over the hammer in its rearward movement. Thus, the cycle of firing one round is completed and the weapon is now reloaded and recocked and ready for firing again. The action of buffer rod 17, buffer spring 18, and buffer housing 16 serves to recycle the bolt/bolt carrier assembly 20, 21 after firing of each individual round.

Thus, the present invention discloses an M16 pistol capable of firing the high pressure, high capacity rifle cartridges such as the 5.56 NATO round (.223 REM.). Although the present invention is disclosed in semi-automatic format, it is obvious that the present invention could also be utilized in a full automatic, submachine gun configuration by altering the conventional AR15 semi-automatic lower receiver assembly into the conventional M16 full automatic receiver assembly by the use of the full-auto sear and the proper safety, disconnector, trigger and hammer assembly. Since, as previously mentioned, the lower receiver and the lower receiver assembly are conventional M16 construction (except for the blanked off rear face 36 of the receiver), one skilled in the art can easily modify the present invention to fire either semi-automatic (AR15) or fully automatic (M16) with conventionally obtainable parts.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For example, whereas the present invention is described with reference to the 5.56 NATO caliber, it is clear that the invention could be used in other calibers including rifle and handgun calibers such as 6 mm, .222 Rem, .222 Rem Magnum, .17 Rem, .22 Hornet, .223 Rem, .218 Bee, 219 Wasp, 22 PPC, .225 Win, 220 Swift, .243 Win, .308 Win, .22–250, and many others, by modifications known to those skilled in the art, given the teachings of this disclosure. Thus, the invention is declared to cover all changes and modifications of the specific example of the invention herein disclosed for purposes of illustration which do not constitute departure from the spirit and scope of the invention.

The embodiments of the invention in which an exclusive property or privilege is claimed are defined as follows:

1. A pistol comprising upper and lower receiver assemblies, a gas-actuation system, and a barrel;

said lower receiver assembly having a squared-off rear surface;

said upper receiver assembly having a buffer spring assembly mounted on top thereof and a bolt carrier assembly slidably mounted therein;

said buffer spring assembly engaging said bolt carrier assembly to resiliently bias said bolt carrier assembly into engagement with a cartridge chamber formed on the end of said barrel;

said buffer spring assembly comprising a buffer rod, a buffer spring mounted concentrically on said buffer rod, and a buffer housing enclosing said buffer rod and buffer spring; said rod, spring, and housing arranged to resiliently bias said rod continuously into said housing;

said buffer spring assembly further comprising a connector sleeve fixedly attached to the rear end of said buffer rod and slidably mounted in an elongated slide housing on said upper receiver assembly, said connector sleeve being removably attached to said bolt carrier assembly;

said bolt carrier assembly containing a firing pin; a bolt carrier gas key attached to said bolt carrier by threaded screw means; and, threaded means connecting said connector sleeve to said bolt carrier;

a gas key attachment threaded hole in said bolt carrier;

said threaded screw means comprises a cylindrical buffer connector having a threaded lower end threadedly engaged in said gas key attachment.

2. A pistol comprising upper and lower receiver assemblies, a gas-actuation system, and a barrel:

said lower receiver assembly having a squared-off rear surface;

said upper receiver assembly having a buffer spring assembly mounted on top thereof and a bolt carrier assembly slidably mounted therein;

said buffer spring assembly engaging said bolt carrier assembly to resiliently bias said bolt carrier assembly into engagement with a cartridge chamber formed on the end of said barrel;

said buffer spring assembly comprising a buffer rod, a buffer spring mounted concentrically on said buffer rod, and a buffer housing enclosing said buffer rod and buffer spring; said rod, spring, and housing arranged to resiliently bias said rod continuously into said housing;

said buffer housing being affixed to the top of said pistol, extending from a point above said bolt carrier assembly to a point above said barrel; and said buffer housing being fixedly attached at its forward end to a gas manifold which is snugly attached to said barrel, said manifold having a gas passage formed therein communicating with a gas port passing through said barrel and into the bore of said barrel;

a gas key in said bolt carrier assembly;

a gas tube in said manifold communicating with said gas passage, said tube extending rearwardly into said upper receiver and into slidable engagement with said gas key.

3. A pistol comprising:

a lower receiver assembly;

an upper receiver assembly having a bolt carrier assembly slidably located therein, said upper receiver assembly being pivotally attached to said lower receiver assembly;

a buffer spring assembly mounted on top of said upper receiver assembly and arranged to resiliently bias said bolt carrier assembly forward;

a pistol barrel having a cartridge chamber, said barrel being fixedly engaged in said upper receiver assembly and arranged to receive said bolt carrier assembly in temporary locking engagement therein; and a gas actuation system for communicating heated gas from the bore of said barrel to said bolt carrier assembly.

4. The pistol of claim 3 further comprising a rear bulkhead blocking off the rear end of said lower receiver assembly.

5. The pistol of claim 3, wherein said upper receiver assembly comprises an elongated slide housing attached to the top of said upper receiver assembly.

6. The pistol of claim 5 further comprising a scope mounting base located on top of said slide housing.

7. The pistol of claim 3, wherein said bolt carrier assembly comprises an M16 bolt carrier modified by having about one-half of the rear portion thereof removed.

8. The pistol of claim 5, wherein said upper receiver assembly further comprises an elongated slot formed in the top thereof between the upper receiver body and said elongated slide housing.

9. The pistol of claim 7, wherein said bolt carrier assembly further comprises a connector pin threadedly engaging a gas key screw hole in said bolt carrier.

* * * * *